US007090345B2

(12) United States Patent
Pierce

(10) Patent No.: US 7,090,345 B2
(45) Date of Patent: Aug. 15, 2006

(54) PORTABLE PRINTER

(76) Inventor: Cynthia Pierce, 7767 Celebrity St., Sacramento, CA (US) 95832

( * ) Notice: Subject to any disclaimer, the term of this patent is extended or adjusted under 35 U.S.C. 154(b) by 0 days.

(21) Appl. No.: 11/201,180

(22) Filed: Aug. 11, 2005

(65) Prior Publication Data

US 2006/0061646 A1 Mar. 23, 2006

Related U.S. Application Data

(60) Provisional application No. 60/611,312, filed on Sep. 21, 2004.

(51) Int. Cl.
*B41J 29/13* (2006.01)

(52) U.S. Cl. ..... 347/108; 347/109; 400/693

(58) Field of Classification Search ..... 347/108, 347/109, 2; 400/693
See application file for complete search history.

(56) References Cited

U.S. PATENT DOCUMENTS

| | | | | |
|---|---|---|---|---|
| 4,904,100 | A | 2/1990 | Enix | |
| 5,061,097 | A | 10/1991 | Piatt | |
| D322,278 | S | 12/1991 | Kawashima et al. | |
| D322,982 | S | 1/1992 | Tashiro | |
| D339,158 | S | 9/1993 | Sato | |
| 6,109,805 | A * | 8/2000 | Ono et al. | 400/618 |
| 2003/0063908 | A1 | 4/2003 | Silverbrook | |

FOREIGN PATENT DOCUMENTS

| | | | |
|---|---|---|---|
| JP | 02080275 | A * | 3/1990 |
| JP | 04269572 | A * | 9/1992 |
| JP | 08058192 | A * | 3/1996 |
| JP | 10139224 | A * | 5/1998 |
| JP | 2000-025304 | | 1/2000 |

* cited by examiner

*Primary Examiner*—Stephen Meier
*Assistant Examiner*—Ly T. Tran
(74) *Attorney, Agent, or Firm*—Richard C. Litman

(57) ABSTRACT

The portable printer includes a housing having a bottom wall, a plurality of sidewalls, and a top wall defining a compartment having an anterior portion and a posterior portion. The top wall has an anterior section, a middle section and a rear section. The anterior section is pivotally connected to the middle section of the top wall and covers the anterior portion of the compartment, and a posterior lid is pivotally connected to the middle section of the top wall and covers the posterior portion of the compartment. A print head assembly, a primary feed mechanism and circuitry are disposed within the housing in order to feed a print medium through the printer and apply ink to the medium. A rechargeable battery may be connected to the circuitry.

18 Claims, 8 Drawing Sheets

PORTABLE PRINTER

CROSS-REFERENCE TO RELATED APPLICATION

This application claims the benefit of U.S. Provisional Patent Application Ser. No. 60/611,312, filed Sep. 21, 2004.

BACKGROUND OF THE INVENTION

1. Field of the Invention

The present invention relates to printing apparatus and, in particular, to a portable printer for producing print media for portable computers.

2. Description of the Related Art

The advances in portable computers, and communication technologies have lead to an increase in mobility. With this increase in mobility, there is a need to quickly print out documents from portable computers, such as laptop computers, wherever the user is located. For example, the user may be at a location where there is limited working space or at a location where there is no access to an external power source for operating the portable printer. Some portable printers are too bulky or heavy for carrying with the laptop computer. Accordingly, there is a continuing need for a portable printer that is lightweight, battery-operated, uses limited working space, and is conveniently available to print documents from a laptop computer wherever the user is located.

Thus, a portable printer solving the aforementioned problems is desired.

SUMMARY OF THE INVENTION

The portable printer is a portable printer designed and configured to be lightweight to facilitate being transported by a user. The dimensions of the printer housing are similar to, or slightly larger than, a conventional laptop computer to accommodate the placement of a laptop computer on the portable printer.

The portable printer is battery-operated and uses black and color ink or toner cartridges. The portable printer includes a housing that has a bottom wall, a plurality of sidewalls extending from the bottom wall, and a top wall attached to the sidewalls defining a compartment having an anterior portion and a posterior portion. The top wall has an anterior section, a medial section and a posterior section. The anterior section of the top wall is pivotally attached to the medial section and covers the anterior portion of the compartment, and the posterior section is pivotally attached to the medial section and covers the posterior portion of the compartment.

The top wall provides a support structure for supporting a laptop computer, which may be positioned on top of the portable printer. In addition, a print head assembly and a primary feed mechanism are communicatively linked to circuitry within the housing that controls the operation of the print head assembly and primary feed mechanism. A rechargeable battery is disposed within the housing and is operatively linked to the circuitry in order to provide an energy source to operate the portable printer.

One of the sidewalls is a front wall and the opposing sidewall is a rear wall. The front wall includes an exit opening for a print medium, such as paper, to exit the housing. A first releasable retaining mechanism is attached to the front wall and is configured to selectively engage the anterior portion of the top wall, and a second releasable retaining mechanism is attached to the rear wall and is configured to selectively engage the posterior portion of the top wall.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
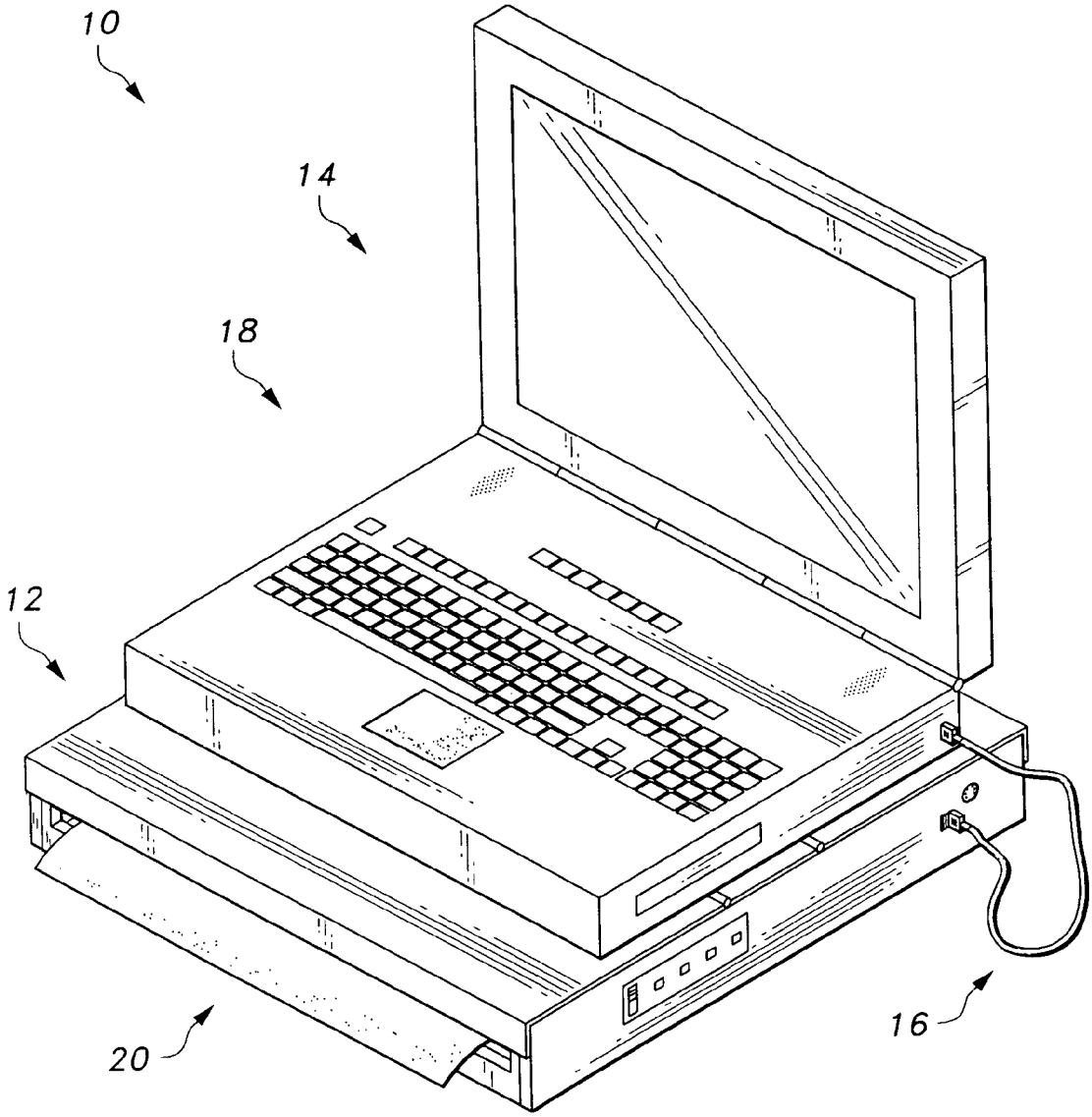
FIG. 1 is an environmental perspective view of a portable printer according to the present invention with a laptop computer disposed thereon to form a portable workstation.

In the drawings, reference numeral 10 generally indicates an apparatus for printing information to print media. As shown in FIG. 1, the apparatus 10 includes a portable printer 12 with a laptop computer 14 disposed thereon. The portable printer 12 and the laptop computer 14 define a portable workstation 18. The portable workstation 18 is constructed and arranged to save working space. The portable printer 12 is communicatively linked to the laptop computer 14 by a communication link mechanism 16, such as a cable, wire, adaptor, converter, host, USB link and/or extension, or any other link, which provides a means for the laptop computer 14 to communicate with the portable printer 12 for printing information on a print medium 20, such as paper, photo image paper, labels, or any other print media. The communication link mechanism 16 can be configured and adapted to communicatively link between USB ports, IEEE 1284 parallel ports, or any other type of ports that are disposed on the portable printer 12 and the laptop computer 14.

Figure 2:
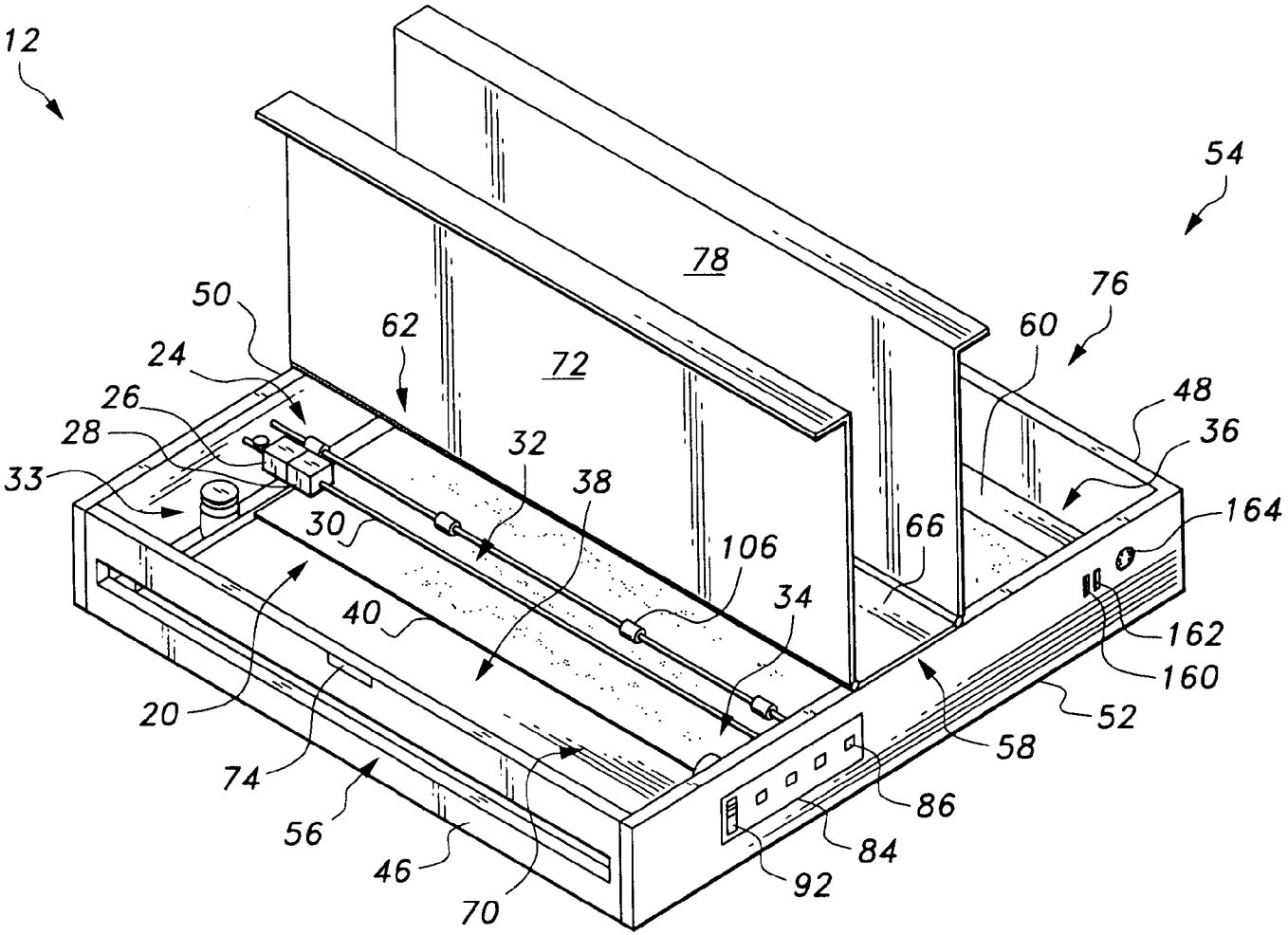
FIG. 2 is a front perspective view of a portable printer according to the present invention with the front and rear lids in the up position.
Figure 3:
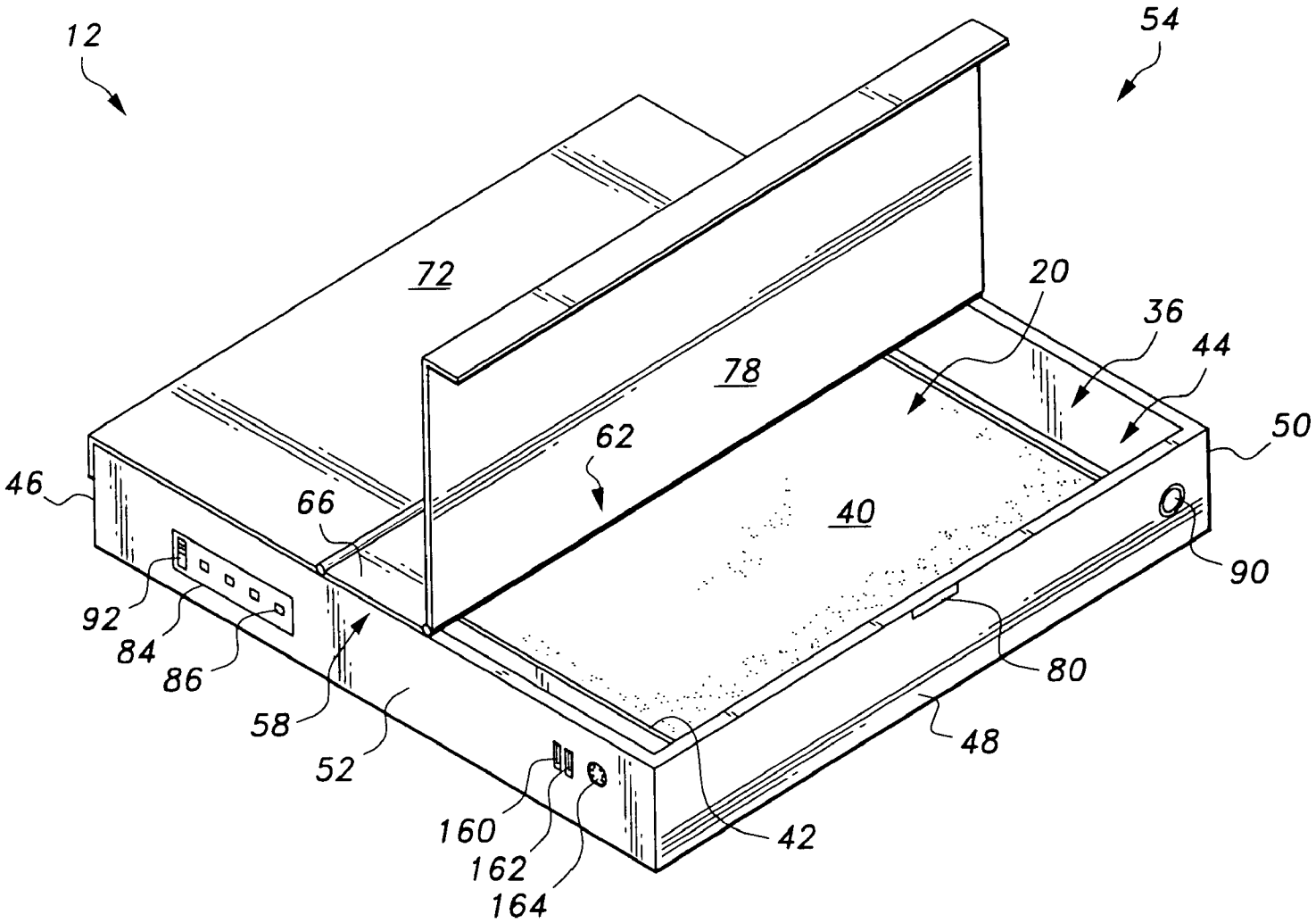
FIG. 3 is a rear perspective view of a portable printer according to the present invention with the rear lid raised and housing portions broken away to show portions of the printer interior.
Figure 4:
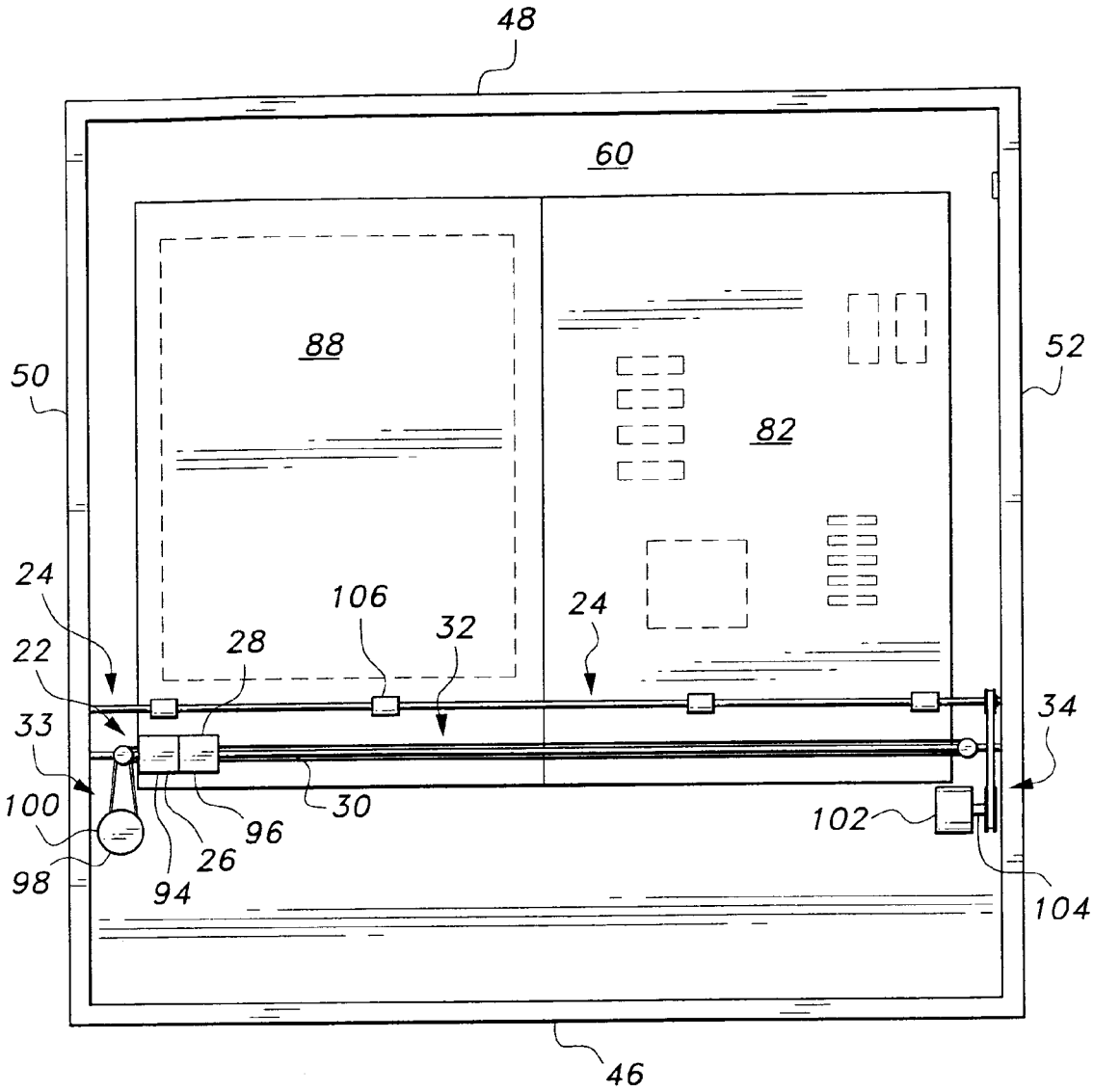
FIG. 4 is a top view of a portable printer according to the present invention, indicating various components therein.

As illustrated in FIGS. 2–4, the portable printer 12 includes a print head assembly 22 and a primary feed mechanism 24. The print head assembly 22 and primary feed mechanism 24 are described in greater detail below, however, in general the print assembly 22 includes one or more print heads 26, 28 movably coupled to a support arm 30 such that the print heads 26, 28 are positioned to traverse or span a printing zone indicated generally as 32. A motor and gearbox means 33 is coupled to the print head assembly 22 for providing the means to move the print heads 26, 28.

The primary feed mechanism 24 is positioned on an in-feed side of the printing zone 32 and is drivingly connected by means of a motor and gearbox mechanism 34. The primary feed mechanism 24 functions as print media advancing means to move print medium 20, such as a paper 40, from a media supply tray 36, such as a paper supply tray 42 or media supply receptacle 44, disposed within the portable printer 12 past the traversing printing path of the print heads 26 and 28, respectively, which define the printing zone 32, and to an exiting zone 38, wherefrom the paper 40 exits the portable printer 12.

Figure 5:
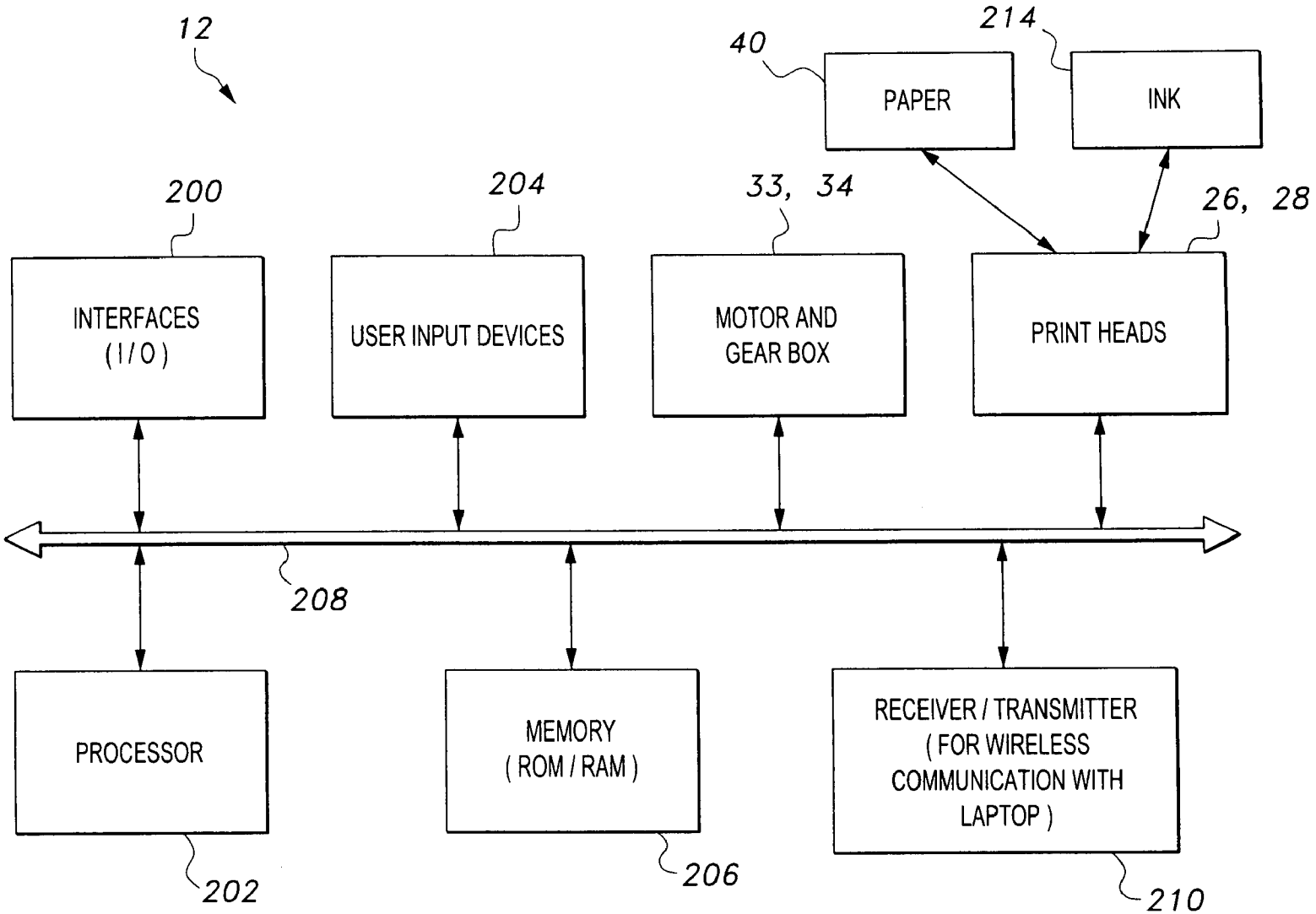
FIG. 5 is a block diagram indicating the various components of a portable printer according to the present invention.

Various components of the portable printer 12 are indicated schematically in FIG. 5. As can be seen, the portable printer 12 includes one or more processor(s) 202, interfaces 200 for inputting and outputting data, user input devices 204, memory 206 for storing data, motor and gearbox mechanism 33 and 34, receiver and/or transmitter 210, print heads 26 and 28, and system and/or data bus 208 that communicatively links the various components.

The processors 202 process various instructions to control the operation of the portable printer 12, such as the motors 98, 102 and gearboxes 100, 104, while interfaces 200 provide a mechanism for portable printer 12 to communicate with other electronic and computing devices, such as the laptop computer 14. User input devices 204 include a control panel 84 or other mechanisms for interaction with, and inputting information to, portable printer 12. The memory 206, such as ROM and/or RAM, provides data storage mechanisms for portable printer 12. The print heads 26, 28 are in fluid communication with the ink cartridges 94, 96 and provide a means for ink to be fed to the nozzle arrangements of print head chips, which are part of the print heads 26, 28. The system and/or data bus 208 serves to communicatively link the various components.

The receiver and/or transmitter 210 communicatively link the portable printer 12 with other electronic and computing devices, such as laptop computer 14, via a wireless communication link. Receiver and/or transmitter 210 can be configured for wireless communications technologies such as RF (radio frequency), IR (infrared), Bluetooth, and IEEE specification 802.11. For example, receiver and/or transmitter 210 can be implemented as a Bluetooth transceiver that both transmits and receives data.

As shown in FIGS. 2–4, 6 and 7, the portable printer 12 includes a plurality of sidewalls 46, 48, 50, and 52, a top wall 58 that is attached to the sidewalls 46, 48, 50, and 52 and a bottom wall 60. The sidewalls 46, 48, 50, and 52 extend upwardly from the bottom wall 60. The top wall 58 has an anterior section 72, a middle section 66, and a posterior section 78. Sidewall 46 is a front wall and sidewall 48 is a rear wall.

The sidewalls 46, 48, 50, and 52, top wall 58 and bottom wall 60 are connected together to form a housing 54 that is dimensioned so that the portable printer 12 is similar in size to the laptop computer 14. The housing 54 is preferably a substantially rectangular housing. Alternatively, the housing 54 can be a square, trapezoidal, octagonal, oblong, or circular shape. The housing 54 defines a compartment 62 within the housing 54 that has an anterior portion 70 and a posterior portion 76. The anterior portion 70 of the compartment 62 is sized to provide manual access to the print head assembly 22 disposed therein. The posterior portion 76 of the compartment 62 is sized to provide manual access to the media supply tray 36, such as the paper supply tray 42 disposed therein.

The anterior section 72 of the top wall 58 is pivotally connected to the middle section 66 and is sized to interface with the anterior portion 70 of the compartment 62 in a condition generally flush with the top edges of the sidewalls 46, 48, 50, and 52 when moved to a closed position. The anterior section 72 of the top wall 58 is designed and configured to be releasably closeable. The anterior section 72 of the top wall 58 is mounted for pivotal movement of approximately 90° to an open position, which is generally perpendicular with the top surface of the middle section 66 of the top wall 58. Alternatively, the anterior section 72 of the top wall 58 is coupled to the middle section 66 by a hinge or other flexible joint that permits the anterior section 72 of the top wall 58 to fold down over the anterior portion 70 of the compartment 62.

The posterior section 78 of the top wall 58 is pivotally connected to the middle section 66 and is sized to interface with the posterior portion 76 of the compartment 62 in a condition generally flush with the top edges of the sidewalls 46, 48, 50, and 52 when moved to a closed position. The posterior section 78 of the top wall 58 is designed and configured to be releasably closeable. The posterior section 78 of the top wall 58 is mounted for pivotal movement of approximately 90° to an open position, which is generally perpendicular with the top surface of the middle section 66 of top wall 58. Alternatively, the posterior section 78 is coupled to the middle section 66 by a hinge or other flexible joint that permits the posterior section 78 of the top wall 58 to fold down over the posterior portion 76 of the compartment 62.

The front wall 46 has a cutout portion that defines an exit opening 56, which serves as an exit location for the print medium 20, such as paper, photos, and other forms of print media to leave the portable printer 12. The exit opening 56 is constructed and arranged to allow the paper 40 to exit the portable printer 12.

One of the sidewalls 52 includes at least one USB port 160, preferably, two USB ports 160, 162 positioned adjacent to each other on the second sidewall 52. Each one of the USB ports 160, 162 is in communication with the various components of the portable printer 12. A secondary interface port 164 is located adjacent to the USB ports 160, 162 on sidewall 52 and is in communication with the various components of the portable printer 12. A control panel 84 is positioned on the sidewall 52 and is configured to communicate with the various components of the portable printer 12. Alternatively, the control panel 84 can be positioned on sidewall 50. Additionally, the USB ports 160, 162 and secondary interface port 164 can be positioned on sidewall 50.

As shown in FIGS. 2 and 3, a releasable retaining mechanism 74 is positioned on the front wall 46 and is configured to selectively engage the anterior section 72 of the top wall 58 when the anterior section 72 is in a closed position. Alternatively, the releasable retaining mechanism 74 can be a latching mechanism that is constructed and arranged to securely latch the anterior section 72 of the top wall 58 in the closed position.

A releasable retaining mechanism 80 is disposed on the rear wall 48 and is positioned to selectively engage the rear lid 78 when the rear lid 78 is in a closed position. Alternatively, the releasable retaining mechanism 80 can be a latching mechanism that is constructed and arranged to securely latch the rear lid in the closed position.

As shown in FIGS. 2–4, the circuitry 82 houses the various components of the portable printer 12, including one or more processors 202. The control panel 84 positioned on sidewall 52 is in communication with the circuitry 82 for communicating information from a user input. The control panel 84 is also configured to communicate information to a user, for example, information such as when there is a problem with the primary feed mechanism 24 or print head assembly 22. The control panel 84 has a printer-actuating button 86, which is communicatively connected to the processors 202. The processors 202 actuate operation of the print head assembly 22 when the printer actuating button 86 is depressed so that data communicated from the laptop computer 14 to the portable printer 12 is printed on the print medium 20, for example, the paper 40.

A rechargeable battery 88 is disposed on the rear wall 48 adjacent to sidewall 50. The rechargeable battery 88 removably connects into a portion of the bottom wall 60 and is securely held in positioned thereof by a holding means, such as a sleeve, saddle, keeper, latch, bracket, or receptacle of the portable printer 12. The rechargeable battery 88 provides energy for the operation of the various components of the portable printer 12. An AC/DC power supply port/connector 90 is disposed on the rear wall 48 next to sidewall 50 and provides an alternative source of energy for the operation of the various components of the portable printer 12. The AC/DC power supply port/connector 90 also provides energy to recharge the rechargeable battery. An on/off power switch 92, such as a toggle switch, button, or any other type of actuator, operates to activate and deactivate the energy source of the portable printer 12. The on/off power switch 92 is disposed on the control panel 84 for turning the portable printer 12 on and off.

Referring to FIGS. 2, 4, and 6–9, the print head assembly 22 includes at least one print head 26 movably coupled to the support arm 30 so that the print heads 26, 28 are positioned to traverse or span the printing zone 32. The print head 26 has a black ink cartridge 94 or ink distribution arrangement mounted thereon. The print head 28 has a color ink cartridge 96 or ink distribution arrangement mounted thereon. Each one of the print heads 26, 28 has a print head chip that is in fluid communication with the ink cartridges 94, 96 or ink distribution arrangement so that ink can be fed to the nozzle arrangements of the print head chips.

The print head assembly 22 includes control circuitry in the form of at least one processor, mounted on the circuitry 82. The print head assembly 22 has a motor 98 that is drivingly connected to a gearbox 100. The processor controls the operation of the motor 98 and the gearbox 100 so that the print heads 26, 28, traverse across the printing zone 32. The processor is typically a microprocessor, however, any type of processor designed to control the operations of the motor 90 and gearbox 100 can be used.

The primary feed mechanism 24 is positioned on an in-feed side of the printing zone 32 and is drivingly connected to a gearbox 104, which causes a rotational motion. The gearbox 104 is drivingly connected to a motor 102. A processor, such as a microprocessor, mounted on the circuitry 82, controls the operation of the motor 102 that drives the gearbox 104. The primary feed mechanism 24 includes at least one roller or wheel, generally indicated at 106. The rollers or wheels 106 are rotatably mounted to the primary feed mechanism 24 to frictionally engage the top surface of the print medium 20, such as the paper 40. The primary feed mechanism 24 feeds or moves the paper 40 through the printing zone 32 and out the exit opening 56. Preferably, the primary feed mechanism 24 includes three rollers 106 spaced equally apart from each other to frictionally engage the print medium 20. Alternatively, a secondary feed roller can be positioned on an out-feed side of the printing zone 32 to further assist moving the paper 40 through the exiting zone 38.

The paper supply tray 42 of the portable printer 12 is positioned within the portable printer 12 so that print media, such as paper 40 are fed through the printing zone 32 by the primary feed mechanism 24. The paper supply tray 42 is designed and configured to hold 1 to 50 sheets of paper. Alternatively, the paper supply tray 42 can be configured to hold 50 to 100 sheets of paper. The paper supply tray 42 is preferably configured to hold about 50 sheets of paper. The sheets of paper can be orientated within the paper supply tray 42 for printing in landscape or portrait positions, respectively.

Preferably, the orientation of the paper 40 is such that the paper 40 moves through the printing zone 32 in a landscape position, which is the height of the paper 40. For example, a standard sized sheet of paper has a width 8.5" and a height of 11". In the landscape position, the height of 11" defines a leading edge of the paper 40, which engages the primary feed mechanism 24.

The paper supply tray 42 is removably mounted within the portable printer 12. A rear portion of the paper supply tray 42 is pivotally mounted to opposing sidewalls 50 and 52 of the portable printer 12 so that a front portion of the paper supply tray 42 is free to move in a generally upwardly and downwardly direction with respect to the front wall 46.

A spring mechanism 112, such as a coil spring, leaf spring, spring clip, or any other type of spring, is positioned between the bottom wall 60 and the paper supply tray 42. The spring mechanism 112 positively engages the bottom of the paper supply tray 42 to move the paper supply tray 42 in an upward direction towards the primary feed mechanism 24 so that the rollers and/or wheels 106 can frictionally engage the sheets of paper 40 housed within the paper supply tray 42. Alternatively, the spring mechanism 112 can be a lever arm that moves the paper supply tray 42 in an upward direction towards the rollers and/or wheels 106 of the primary feed mechanism 24.

A vertical rail member 114 is positioned adjacent to the paper supply tray 42 and provides a guiding means as the paper supply tray 42 moves in an upwardly and downwardly direction. The vertical rail member 114 has one end portion fixed to the bottom wall 60 with the other end portion extending upwardly to a position just below the print head assembly 22 and the exit opening 56. A horizontal rail member 116 is fixed to the front wall 46 adjacent the exit opening 56 and integrally connected to the vertical rail member 114 to form an arcuate or curved surface that guides the moving paper 40 along the horizontal rail member 116 to the exit opening 56. The vertical rail member 114 and horizontal rail member 116 are fixed together to define an L-shaped paper guide, bracket, deck, or platform, which supports the bottom surface of the paper 40 as the paper 40 moves through the printing zone 32 and exits through the exiting opening 56 of the front wall 46.

Figure 6:
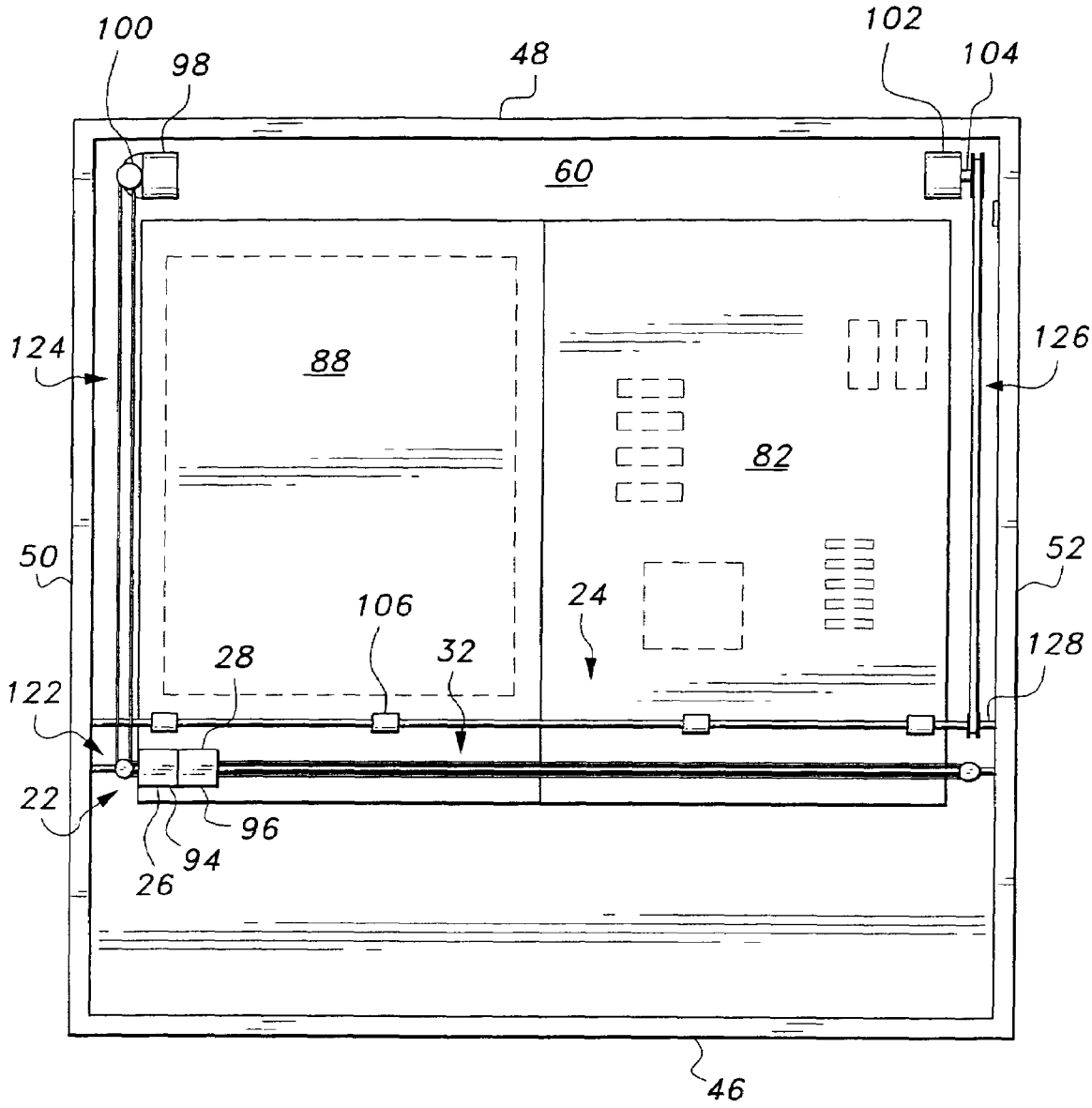
FIG. 6 is a is a top view of a portable printer according to the present invention, indicating various components therein.

FIG. 6 shows the gearboxes 100, 104 and motors 98, 102 positioned in a rear portion of the portable printer 12. The motor 98 is coupled via a gear reduction drive to a cable or belt drive system 124. The cable or belt drive system 124 is drivingly coupled to gearbox 100 and is drivingly coupled to the print head assembly 22, wherein a cable or belt drive system 122 moves the print heads 26, 28. In operation, rotation of motor 98 traverses print head assembly 22 along the support arm 30 by virtue of its coupling to one strand of the cable or belt drive system 122. Motor 102 is coupled to the primary feed mechanism 24 by a secondary cable or belt drive system 126. The secondary belt or cable drive system 126 is coupled to gearbox 104. An axle 128 is coupled to the secondary belt or cable drive system 126 so that the axle 128 rotates about a rotation axis as indicated by the arrow in FIGS. 8–9. The rollers and/or wheels 106 are rotatably mounted to the axle 128. Operation rotation of motor 102 causes gearbox 104 to engage cable or belt system 126, which results in axle 128 rotating the rollers and/or wheels 106.

Figure 7:
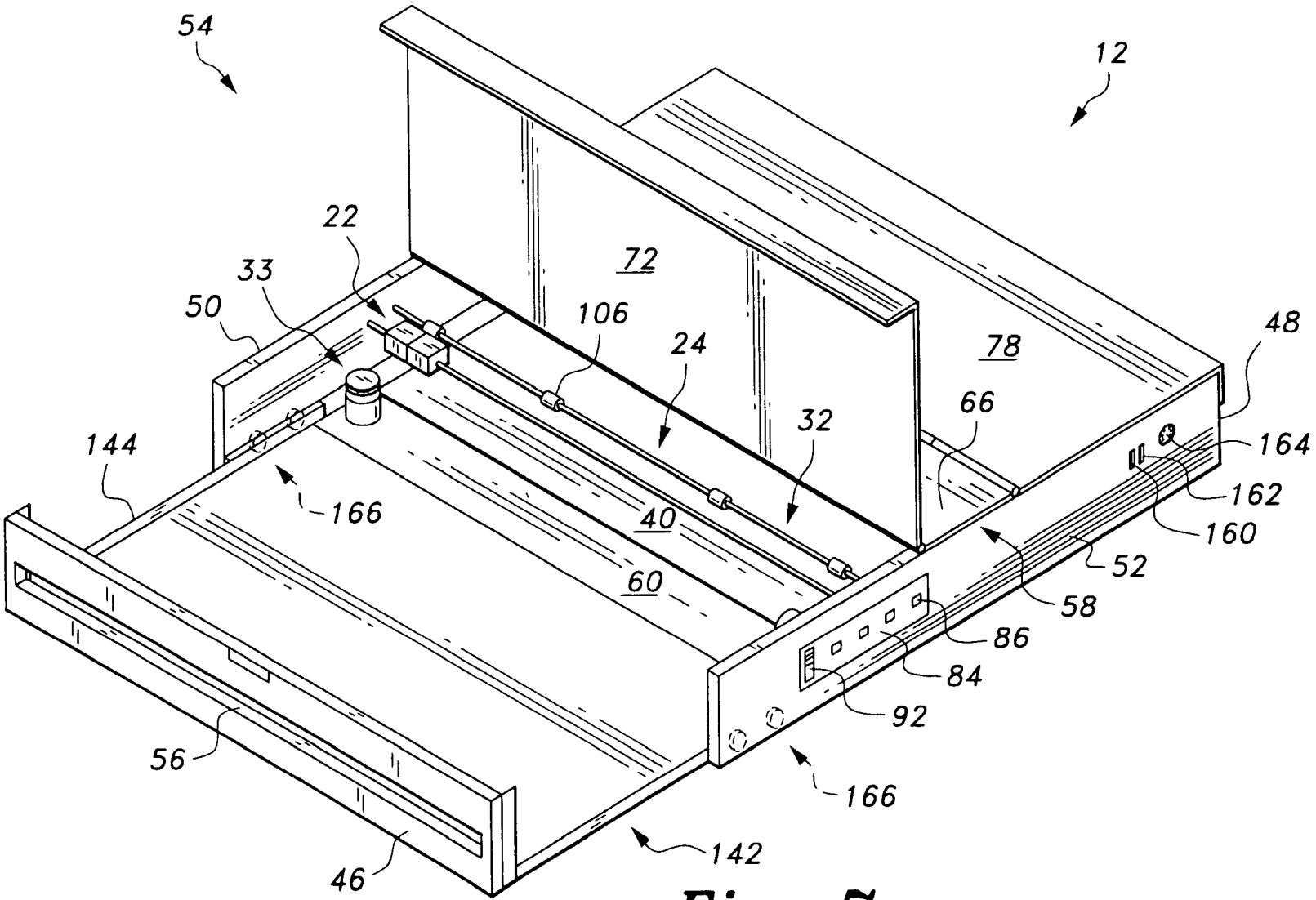
FIG. 7 is a front perspective view of a portable printer according to the present invention, showing the pull-out tray.
Figure 8:
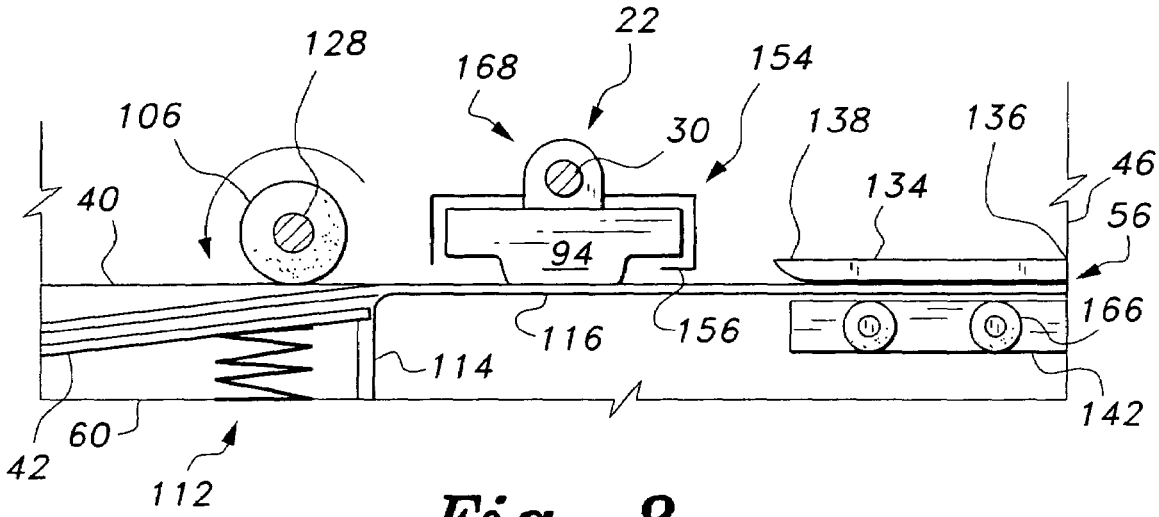
FIG. 8 is a partial detail view of FIG. 7, indicating the position of the roller, printer head, and pull-out tray.

FIGS. 7 and 8 show the portable printer 12 utilizing a pullout paper support member 142 to accommodate the paper 40 exiting from the portable printer 12. In this embodiment, the pullout paper support member 142 is slidably connected to the portable printer 12 so that the pullout paper support member 142 slides in and out of the exit opening 56 of the front wall 46 of the portable printer 12. The pullout paper support member 142 is movably mounted to a plurality of rollers or wheels 166, which allow the pullout paper support member 142 to be position adjacent to the paper 40 exiting the portable printer 12.

The pullout paper support member 142 can be positioned below the paper 40 or next to the side edges of the paper 40. When the pullout paper support member 142 is positioned below the paper 40 exiting the portable printer 12, the pullout paper support member 142 includes a pullout paper tray 144 for supporting the paper. When the pullout paper support member 142 is positioned next to the side edges of the paper 40, the pullout paper support member 142 comprises two guide rails, which movably extend outwardly from the exit opening 56 to support the paper exiting the portable printer 12.

The portable printer 12 includes a paper guide member 134, which is positioned above the paper 40 exiting from the printer head assembly. The paper guide member 134 has a forward end portion 136 and a rearward end portion 138. The forward end portion 136 is mounted above the exit opening 56 of the front wall 46 and extends toward the print head assembly 22. The rearward end portion 138 of the paper guide member 134 is arcuate or curved in a manner which guides the paper 40 along the bottom of the paper guide member 134 to the exit opening 56, wherein the paper 40 exits the of the portable printer 12.

Figure 9:
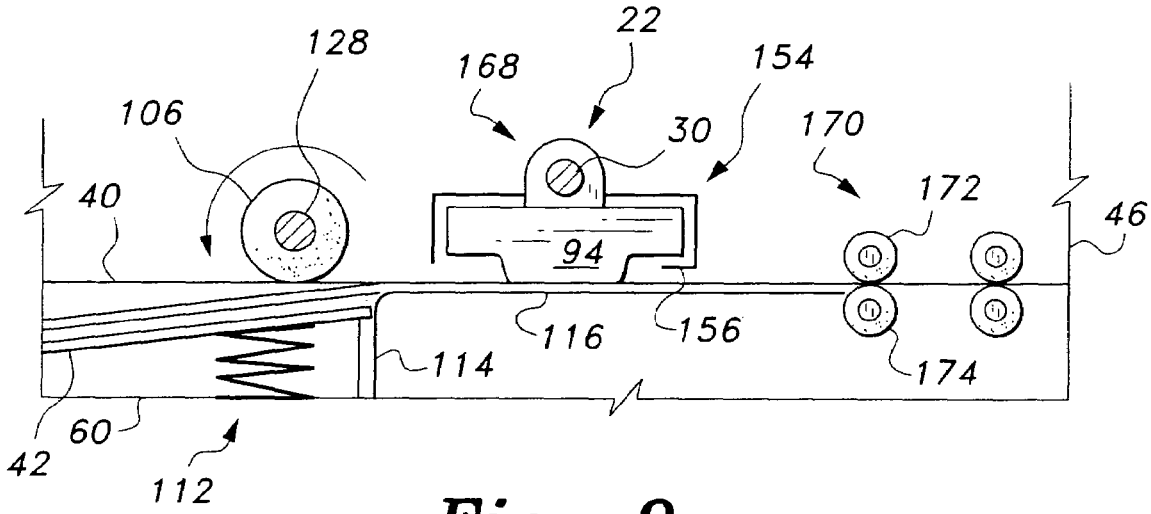
FIG. 9 is a partial detail view of FIG. 2, indicating the position of the roller, printer head, and pull-out tray.

FIG. 9 shows a configuration for guiding the paper 40 exiting the portable printer 12. In this embodiment, the paper guide member 134 is a roller assembly 170. The roller assembly 170 has top rollers 172 and bottom rollers 174 that are positioned to engage the top surface and bottom surface of paper 40, respectively. The top and bottom rollers 172, 174 can be of any shape and size. Alternatively, the rollers 172, 174 can be wheels. The roller assembly 170 is mounted to the first and second sidewalls 50, 52, and are positioned adjacent to the front wall 46 so that the paper 40 moves between the top and bottom rollers 172, 174 as the paper 40 exits through the exit opening 58 of the front wall 46.

Figure 10:
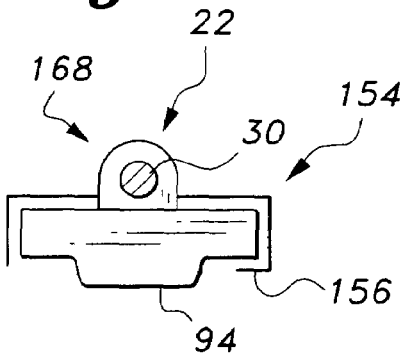
FIG. 10 is a detail view of FIG. 2, showing the print cartridge holder and print cartridge.

FIGS. 8–10 show one of the ink cartridges 94 removably mounted to the print head assembly 22. The print head assembly 22 is movably mounted to the support arm 30 by means of a sleeve and collar assembly 168, which allows the print head assembly 22 to slide or move along the support arm 30 so that the print heads 26, 28 span the printing zone 32.

The print head assembly 22 is configured to allow the ink cartridges 94, 96 to connect or fasten into a holding position within the print heads 26, 28. The print heads 26, 28 include a top and two opposing sides that extend downwardly from the top to define a U-shaped bracket 154. An arm 156 is fixed to the bottom edge portion of the U-shaped bracket 154 and extends inwardly thereof. The ink cartridges 94, 96 have a first end and a second end. The first end is positioned adjacent to the arm 156. The second end frictionally engages the U-shaped bracket 154, which securely holds the ink cartridges 94, 96 within the bracket 154. Alternatively, any conventional print heads and ink cartridges can be utilized as the print head assembly 22.

It is to be understood that the present invention is not limited to the embodiments described above, but encompasses any and all embodiments within the scope of the following claims.

I claim:

1. A portable printer, comprising:

a housing having a bottom wall, a plurality of sidewalls extending upwardly from the bottom wall, the plurality of sidewalls including a front wall, a rear wall, and opposing sidewalls extending between the front and rear walls, the housing further having a top wall attached to the opposing sidewalls, the housing defining a compartment having an anterior portion and a posterior portion, the top wall having an anterior section, a middle section and a posterior section defining a flat surface adapted for supporting a laptop computer, the anterior section being pivotally connected to the middle section and covering the anterior portion of the compartment when the anterior section of the top wall is closed, the posterior section being pivotally connected to the middle section and covering the posterior portion of the compartment when the posterior section is closed;

a print head assembly disposed inside the housing for distributing ink to a print medium;

a primary feed mechanism for feeding the print medium to the print head assembly; and circuitry communicatively linked to the print head assembly and primary feed mechanism for controlling operation of the primary feed mechanism and the print head assembly.

2. The portable printer according to claim 1, further comprising a rechargeable battery disposed within the housing, the rechargeable battery being operatively linked to the circuitry in order to provide an energy source to operate the portable printer.

3. The portable printer according to claim 1, wherein the front wall has an exit opening defined therein adapted for a print medium exiting the housing.

4. The portable printer according to claim 1, wherein the housing has a substantially rectangular shape.

5. The portable printer according to claim 1, further comprising a communication link mechanism connected to the printer circuitry adapted for communicating information between the printer circuitry and the laptop computer.

6. The portable printer according to claim 1, further comprising:

a first releasable retaining mechanism attached to the front wall and selectively engaging the anterior section of the top wall; and a second releasable retaining mechanism attached to the rear wall selectively engaging the posterior section of the top wall.

7. The portable printer according to claim 1, further comprising a paper supply tray removably mounted within the compartment defined by the housing.

8. The portable printer according to claim 7, further comprising a transmitter/receiver unit disposed within the housing adapted for communicatively linking the portable printer to the laptop computer.

9. A portable printer, comprising:

a housing having a bottom wall, a plurality of sidewalls extending upwardly from the bottom wall, the sidewalls including a front wall, a rear wall, and opposing sidewalls extending between the front and rear walls, the housing further having a top wall attached to the opposing sidewalls, the housing defining a compartment having an anterior portion and a posterior portion, the top wall having an anterior section, a middle section and a posterior section defining a flat surface adapted for supporting a laptop computer, the anterior section being pivotally connected to the middle section and covering the anterior portion of the compartment when the anterior section of the top wall is closed, the posterior section being pivotally connected to the middle section and covering the posterior portion of the compartment when the posterior section is closed;

means for distributing ink to a print medium;

means for feeding the print medium through the housing; and circuitry for controlling the distribution of ink to the print medium and feeding the print medium through the housing.

10. The portable printer according to claim 9, further comprising a rechargeable battery disposed within the housing, the rechargeable battery being operatively linked to the circuitry in order to provide an energy source to operate the portable printer.

11. The portable printer according to claim 9, wherein said means for distributing ink to the print medium comprises a print head assembly.

12. The portable printer according to claim 11, wherein said means for feeding the print medium through the housing comprises a primary feed mechanism for feeding the print medium to the print head assembly.

13. The portable printer according to claim 9, wherein the front wall has an exit opening defined therein for the print medium to exit the housing.

14. The portable printer according to claim 9, wherein the housing has a substantially rectangular shape.

15. The portable printer according to claim 9, further comprising a communication link mechanism connected to the printer circuitry adapted for communicating information between the printer circuitry and a laptop computer.

16. The portable printer according to claim 9, further comprising:

a first releasable retaining mechanism attached to the front wall and selectively engaging the anterior section of the top wall; and a second releasable retaining mechanism attached to the rear wall and selectively engaging the posterior section of the top wall.

17. The portable printer according to claim 9, further comprising a paper supply tray removably mounted within the compartment defined by the housing.

18. The portable printer according to claim 9, further comprising a transmitter/receiver unit disposed within the housing adapted for communicatively linking the portable printer to the laptop computer.

* * * * *